US011204033B2

(12) United States Patent
Kawai et al.

(10) Patent No.: US 11,204,033 B2
(45) Date of Patent: Dec. 21, 2021

(54) OIL PUMP DRIVING DEVICE

(71) Applicant: NTN CORPORATION, Osaka (JP)

(72) Inventors: Masahiro Kawai, Shizuoka (JP); Takahide Saito, Shizuoka (JP)

(73) Assignee: NTN CORPORATION, Osaka (JP)

( * ) Notice: Subject to any disclaimer, the term of this patent is extended or adjusted under 35 U.S.C. 154(b) by 629 days.

(21) Appl. No.: 15/762,425

(22) PCT Filed: Sep. 21, 2016

(86) PCT No.: PCT/JP2016/077886
§ 371 (c)(1),
(2) Date: Mar. 22, 2018

(87) PCT Pub. No.: WO2017/051828
PCT Pub. Date: Mar. 30, 2017

(65) Prior Publication Data

US 2018/0283375 A1 Oct. 4, 2018

(30) Foreign Application Priority Data

Sep. 24, 2015 (JP) ..... 2015-186878

(51) Int. Cl.
*F04C 15/00* (2006.01)
*F04C 2/344* (2006.01)
*F04C 29/00* (2006.01)

(52) U.S. Cl.
CPC ..... *F04C 15/0061* (2013.01); *F04C 2/344* (2013.01); *F04C 15/00* (2013.01); *F04C 29/005* (2013.01)

(58) Field of Classification Search
CPC .... F04C 15/00; F04C 15/0061; F04C 29/005; F04C 2/344; F04C 2/10; F16H 61/00; B60K 6/40; F16D 41/067
(Continued)

(56) References Cited

U.S. PATENT DOCUMENTS 4,521,169 A 6/1985 Ogawa
5,993,169 A * 11/1999 Adachi ..... B60K 6/40 417/223

(Continued)

FOREIGN PATENT DOCUMENTS

CN 103032311 4/2013
JP 59-154882 10/1984

(Continued)

OTHER PUBLICATIONS

English Abstract of JP 2013072371A (Year: 2013).*

(Continued)

*Primary Examiner* — Mary Davis
*Assistant Examiner* — Paul W Thiede
(74) *Attorney, Agent, or Firm* — Wenderoth, Lind & Ponack, L.L.P.

(57) ABSTRACT

An oil pump includes a hollow rotor having an inner peripheral portion defining a space inside of the inner peripheral portion. A first one-way clutch configured to transmit the motive power input from an engine side, to the rotor only in one direction, and a second one-way clutch configured to transmit the motive power input from an electric motor side, to the rotor only in the one direction are arranged inside of the inner peripheral portion of the rotor.

3 Claims, 4 Drawing Sheets

(58) Field of Classification Search
USPC ..... 418/38, 68, 69
See application file for complete search history.

(56) References Cited

U.S. PATENT DOCUMENTS

| | | | | |
|---|---|---|---|---|
| 6,135,740 | A | 10/2000 | Hult et al. | |
| 2011/0036319 | A1* | 2/2011 | Kameda | F01L 1/344 123/90.17 |
| 2013/0030624 | A1* | 1/2013 | Suyama | B60W 10/02 701/22 |
| 2016/0368003 | A1* | 12/2016 | Vester | B04B 13/00 |
| 2017/0279336 | A1* | 9/2017 | Komi | F16H 3/003 |
| 2019/0017588 | A1* | 1/2019 | Kawai | B60K 17/26 |

FOREIGN PATENT DOCUMENTS

| | | | | |
|---|---|---|---|---|
| JP | 2007002947 A | * | 1/2007 | |
| JP | 2011-106543 | | 6/2011 | |
| JP | 2013072371 A | * | 4/2013 | F04C 2/102 |
| JP | 2014-177902 | | 9/2014 | |

OTHER PUBLICATIONS

English machine Translation of JP 2007002947 A. Translated from Espacenet on Nov. 1, 2020. (Year: 2007).*
English machine Translation of JP 2013072371A. Translated from Espacenet on Nov. 1, 2020. (Year: 2013).*
Figures associated with JP 2007002947 A. (Year: 2007).*
English Abstractor JP 2007002947A. (Year: 2007).*
International Preliminary Report on Patentability dated Mar. 27, 2018 in International (PCT) Application No. PCT/JP2016/077886.
International Search Report dated Nov. 8, 2016 in International (PCT) Application No. PCT/JP2016/077886.
Extended European Search Report dated Sep. 10, 2018 in European Application No. 16848616.5.

* cited by examiner

OIL PUMP DRIVING DEVICE

TECHNICAL FIELD

The present invention relates to an oil pump driving device mounted in automobiles.

BACKGROUND ART

For example, a vane pump including a rotor configured to receive motive power, or an internal gear pump is used as an oil pump for supplying hydraulic oil to fluid devices mounted in an automobile, such as a hydraulic power steering system and a hydraulic stepless transmission (see Japanese Unexamined Patent Application Publication No. 2014-177902 (hereinafter, "JP 2014-177902") and Japanese Unexamined Patent Application Publication No. 2011-106543 (hereinafter, "JP 2011-106543")).

In an automobile provided with a control device configured to stop the engine under a predetermined stop condition, and to start the engine under a predetermined start condition, e.g. when the accelerator pedal is pressed, an oil pump is driven by the electric motor while the engine is not operating.

The oil pump driving device disclosed in JP 2011-106543 includes a single oil pump; a path through which the motive power output from the engine is transmitted to the oil pump; and a path through which the motive power output from the electric motor is transmitted to the oil pump. These paths each includes a one-way clutch configured to selectively permit and stop the transmission of motive power to the oil pump. Theses one-way clutches are both configured to be locked/engaged when motive power in the same one direction is applied thereto (so as to transmit the motive power). Such an oil pump driving device is therefore configured such that the single oil pump can be driven by either of the engine and the electric motor.

SUMMARY OF THE INVENTION

Problems to be Solved by the Invention

However, in the oil pump driving device of JP 2011-106543, since the two one-way clutches are disposed on the respective sides of the oil pump, the entire axial length of the housing in which these components are received is large. As a result thereof, it is difficult to mount this oil pump driving device to the engine or the transmission.

In view of the above background, it is an object of the present invention to provide an oil pump driving device which includes a single oil pump capable of being driven by either of the engine and the electric motor, and which is short in entire axial length.

Means for Solving the Problems

In order to achieve the above object, the present invention provides an oil pump driving device comprising: a single oil pump including a rotor configured to receive motive power; a first one-way clutch configured to transmit motive power input from an engine side, to the rotor only in one direction; and a second one-way clutch configured to transmit motive power input from an electric motor side, to the rotor only in the one direction, characterized in that the rotor comprises a hollow rotor including an inner peripheral portion defining a space inside of the inner peripheral portion, and the first one-way clutch and the second one-way clutch are arranged inside of the inner peripheral portion of the rotor.

With this arrangement, since the motive power input from the engine side can be transmitted through the first one-way clutch to the rotor of the single oil pump only in one direction, and the motive power input form the electric motor side can be transmitted through the second one-way clutch to the rotor only in the one direction, the single oil pump can be driven by either of the engine and the electric motor. Also, since the rotor is a hollow rotor including an inner peripheral portion defining a space inside of the inner peripheral portion, and the first and second one-way clutches, which are configured to transmit motive power to the rotor, are arranged (in the spaced defined) inside of the inner peripheral portion of the hollow rotor, i.e., arranged within the axial width of the rotor, the oil pump driving device is short in axial length.

Effects of the Invention

The oil pump driving device of the present invention, configured such that the single oil pump can be driven by either of the engine and the electric motor, is short in axial length.

BEST MODE FOR CARRYING OUT THE INVENTION

Figure 2:
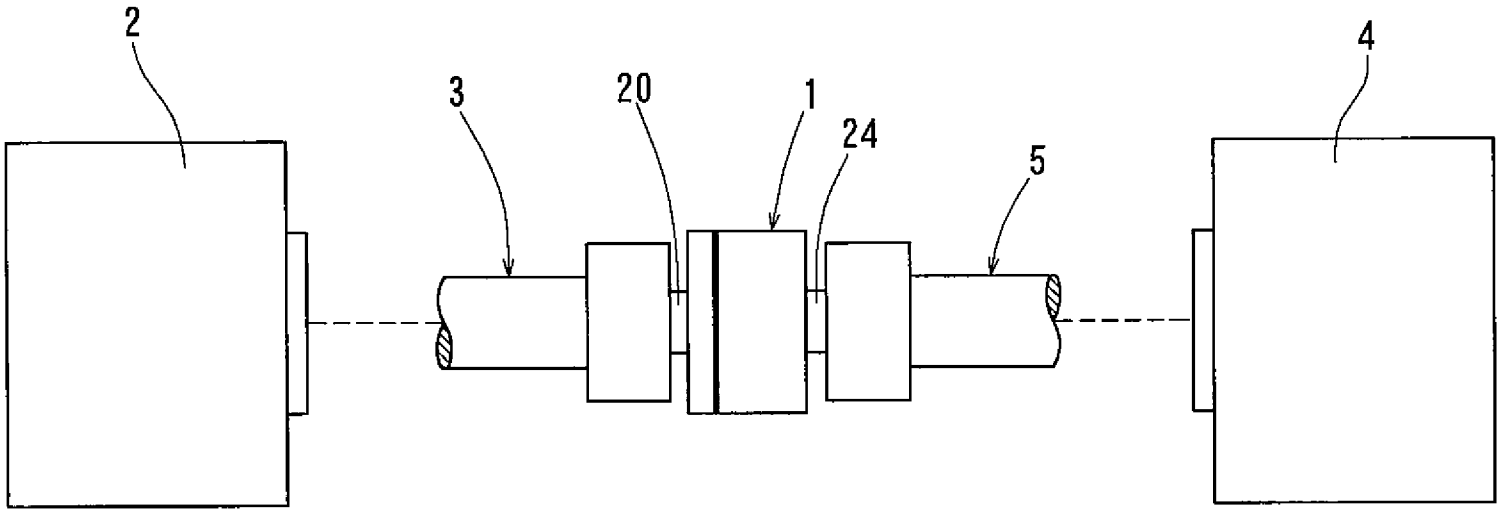
FIG. 2 is a schematic diagram illustrating motive power transmission paths through which motive power is transmitted to the oil pump of the oil pump driving device of FIG. 1.

An oil pump driving device embodying the present invention is now described with reference to the attached drawings. As illustrated in FIG. 2, the oil pump driving device includes a single oil pump 1; an engine side transmission path 3 through which the motive power output from an engine 2 is transmitted to the oil pump 1; and a motor side transmission path 5 through which the motive power output from an electric motor 4 is transmitted to the oil pump 1.

Figure 1:
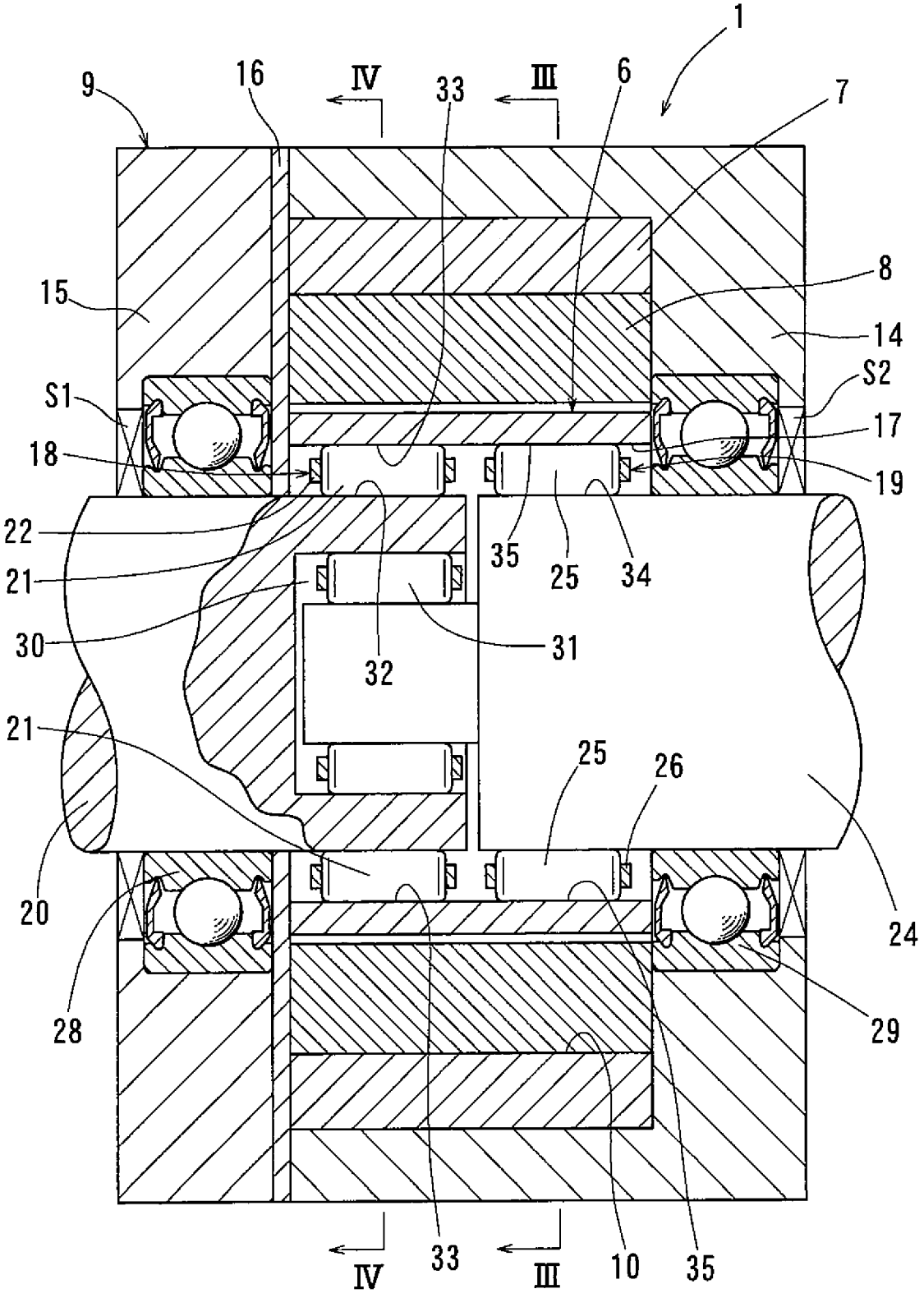
FIG. 1 is a sectional view of an oil pump driving device embodying the present invention.

As illustrated in FIG. 1, the oil pump 1 is a vane pump including a rotor 6 configured to receive motive power; a cam ring 7 surrounding the rotor 6; a plurality of vanes 8 retained by the rotor 6; and a housing 9 in which the rotor 6 and the cam ring 7 are received. The direction along the rotation center axis of the rotor 6 is hereinafter referred to as the "axial direction"; the direction perpendicular to the axial direction is hereinafter referred to as the "radial direction"; and the direction about the rotation center axis of the rotor 6 is hereinafter referred to as the "circumferential direction".

Figure 3:
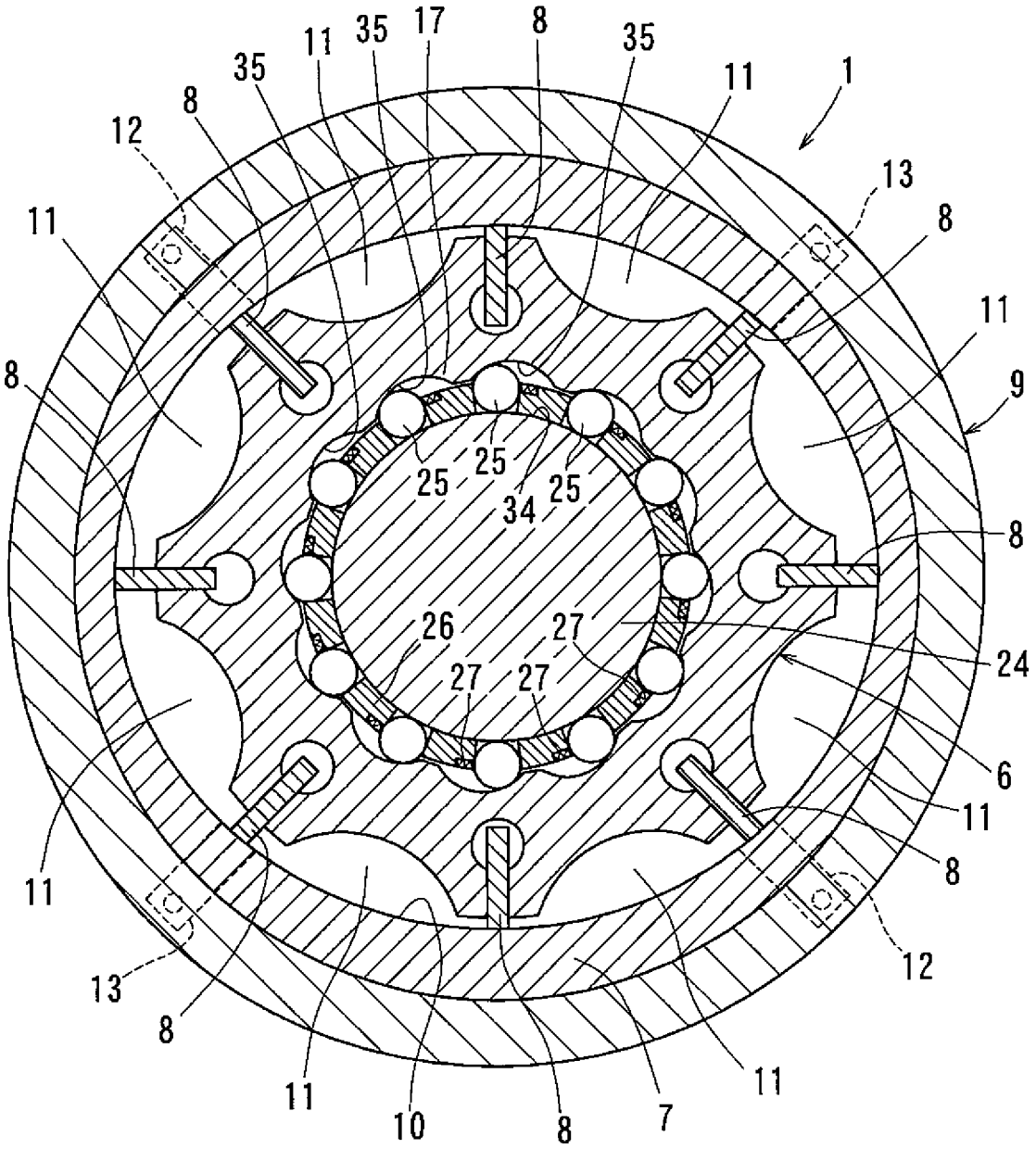
FIG. 3 is a sectional view taken along line of FIG. 1.

As illustrated in FIG. 3, when the rotor 6 rotates by receiving motive power, the vanes 8, retained in respective grooves of the rotor 6 so as to be movable in the radial direction, rotate along an eccentric inner surface 10 of the cam ring 7 while pressed against the inner surface 10 due to the oil pressure applied to the vanes 8 from a hydraulic circuit intersecting with the terminal ends of the grooves of the rotor 6, as well as under centrifugal force. This changes the volumes of oil chambers (pump chambers) 11 defined by the respective circumferentially adjacent pairs of vanes 8, the inner surface 10 of the cam ring 7, and the housing 9, so that oil is sucked into and discharged from the oil chambers 11. The cam ring 7 and the housing 9 are provided with a plurality of oil discharge paths 12 through which the interiors of the oil chambers 11 communicate with the exterior of the housing 9 such that oil is discharged from the oil chambers 11 through the oil discharge paths 12 while the corresponding oil chambers 11 are in the compression phase; and a plurality of oil suction paths 13 through which the interiors of the oil chambers 11 communicate with the exterior of the housing 9 such that oil is sucked into the oil chambers 11 through the oil suction paths 13 while the corresponding oil chambers 11 are in the suction phase.

As illustrated in FIG. 1, the housing 9 includes a housing main body 14 and a housing lid 15 which can be disassembled so that the cam ring 7 and the rotor 6 can be axially received into the housing 9; and a seal ring 16 arranged between the housing main body 14 and the housing lid 15.

While the oil pump 1 is a vane pump in the embodiment, the oil pump 1 may be any oil pump capable of functioning as a pump when the rotor rotates due to the motive power transmitted to the rotor from the engine side transmission path or the motor side transmission path, for example, may be an internal gear pump as disclosed in JP 2011-106543. In this case, the inner rotor of the internal gear pump which has an external gear is used as the rotor for receiving motive power.

The rotor 6 is a hollow rotor including an inner peripheral portion 17 defining a space axially extending through the rotor 6. A first one-way clutch 18 and a second one-way clutch 19 are arranged inside of the inner peripheral portion 17 of the rotor 6. The first one-way clutch 18 constitutes the terminal end of the engine side transmission path 3 (seen in FIG. 2), and the second one-way clutch 19 constitutes the terminal end of the motor side transmission path 5 (seen in FIG. 2).

Figure 4:
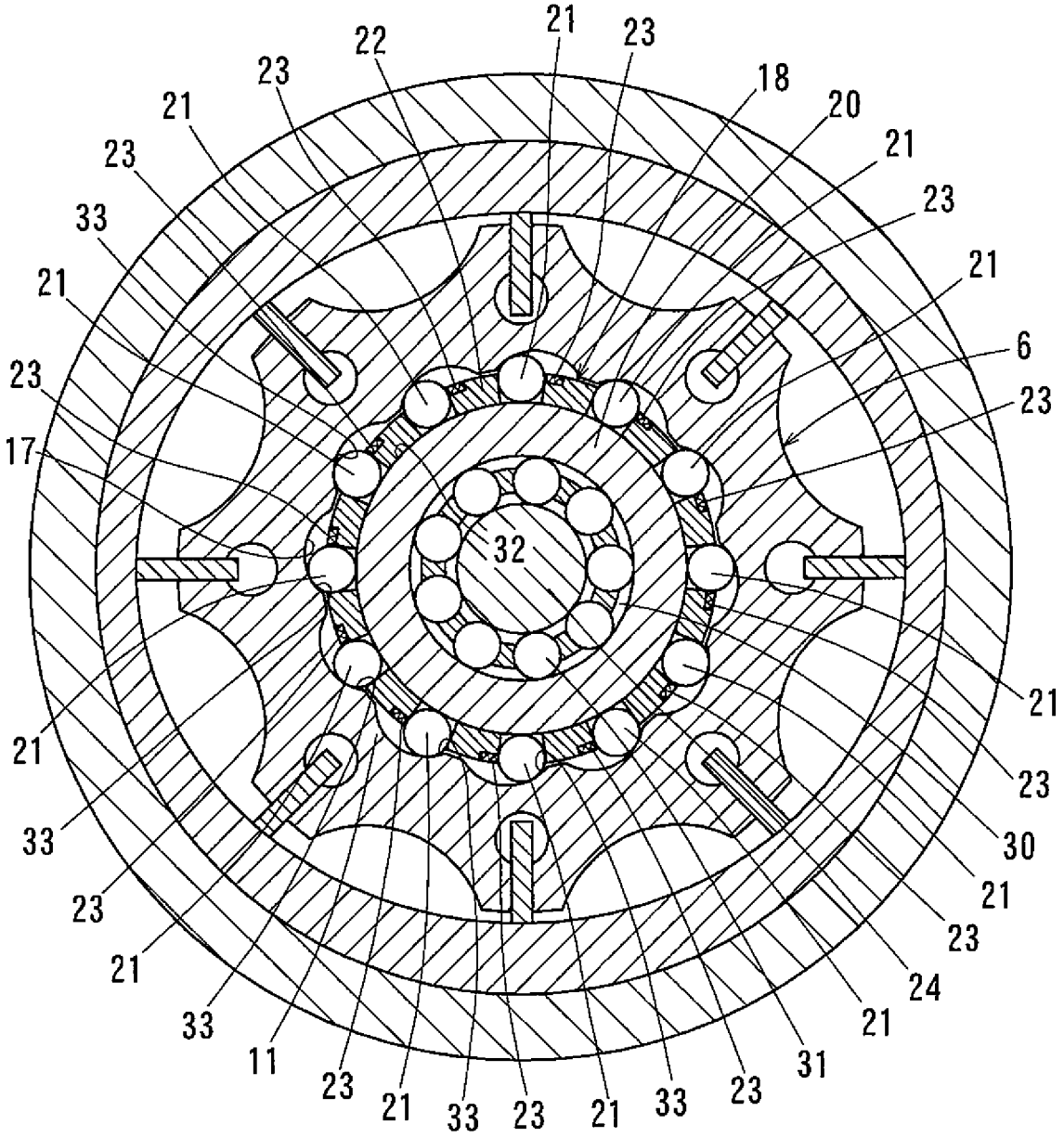
FIG. 4 is a sectional view taken along line IV-IV of FIG. 1.

As illustrated in FIGS. 1 and 4, the first one-way clutch 18 includes a first input shaft 20 inserted into the space defined inside of the inner peripheral portion 17 of the rotor 6 from one axial side (left side in FIG. 1) of the oil pump 1; first engagement elements 21 configured to transmit motive power between the first input shaft 20 and the inner peripheral portion 17 of the rotor 6; a first retainer 22 configured to retain the first engagement elements 21; and first elastic members 23 mounted to the first retainer 22 so as to bias the respective first engagement elements 21.

As illustrated in FIGS. 1 and 3, the second one-way clutch 19 includes a second input shaft 24 inserted into the space defined inside of the inner peripheral portion 17 of the rotor 6 from the other axial side (right side in FIG. 1) of the oil pump 1; second engagement elements 25 configured to transmit motive power between the second input shaft 24 and the inner peripheral portion 17 of the rotor 6; a second retainer 26 configured to retain the second engagement elements 25; and second elastic members 27 mounted to the second retainer 26 so as to bias the respective second engagement elements 25.

As illustrated in FIG. 2, the first input shaft 20 and the second input shaft 24 are connected, outside of the housing 9, to the engine side transmission path 3 and the motor side transmission path 5, respectively. This enables the first input shaft 20 and the second input shaft 24 to function, respectively, as a torque transmission shaft capable of transmitting the motive power output from the engine 2, and as a torque transmission shaft capable of transmitting the motive power output from the electric motor 4.

As illustrated in FIG. 1, the oil pump driving device includes a first radial bearing 28 arranged between the housing 9 and the first input shaft 20, and supporting the first input shaft 20 so as to be rotatable relative to the housing 9; and a second radial bearing 29 arranged between the housing 9 and the second input shaft 24, and supporting the second input shaft 24 so as to be rotatable relative to the housing 9. The first and second radial bearings 28 and 29 receive axial loads in the two opposite axial directions. Each of the first and second radial bearings 28 and 29 is a rolling bearing including an outer race fitted in a bearing seat formed in the housing 9; an inner race fitted on the outer periphery of the corresponding one of the first and second input shafts 20 and 24; and contact seals mounted to the respective sides of the bearing. An oil seal S1 is mounted to the inner periphery of the housing lid 15 at its open end so as to be located outside of the first radial bearing 28, and an oil seal S2 is mounted to the inner periphery of the housing main body 14 at its open end so as to be located outside of the second radial bearing 29, thereby preventing oil from leaking out of the housing 9.

As illustrated in FIGS. 1 and 4, one of the opposed end portions of the first and second input shafts 20 and 24 is a hollow end portion, and the other opposed end portion is inserted in the hollow end portion such that the first and second input shafts 20 and 24 are axially and radially opposed, through a gap 30, to each other inside of the inner peripheral portion 17 of the rotor 6. A bearing 31 is arranged in the annular portion of the gap 30, and supports the second input shaft 24 so as to be rotatable relative to the first input shaft 20. The bearing 31 is a needle bearing utilizing, as its raceways, the inner surface of the one of the opposed end portions of the input shafts 20 and 24, and the outer surface of the other opposed end portion, and including needles retained by a retainer and arranged in the gap 30. While the bearing 31 is such a needle bearing in the embodiment, the bearing 31 may be a rolling bearing including bearing races, or a ball bearing.

The first input shaft 20 has a first cylindrical surface 32 formed on the portion of the outer periphery of the input shaft 20 located inside of the inner peripheral portion 17 of the rotor 6. The rotor 6 has first cam surfaces 33 formed on its inner peripheral portion 17 so as to be circumferentially spaced apart from each other at predetermined intervals such that wedge-shaped spaces are defined between the respective first cam surfaces 33 and the first cylindrical surface 32. The wedge-shaped spaces each narrows in the counterclockwise direction in FIG. 4. The first cylindrical surface 32 may be a surface of an element of the first input shaft 20 provided separately from the main body of the first input shaft 20, and the first cam surfaces 33 may be surfaces of an element or elements of the rotor 6 provided separately from the main body of the rotor 6.

The first engagement elements 21 are rollers received in the respective wedge-shaped spaces described above, and biased by the respective first elastic members 23 in the counterclockwise direction (in FIG. 4) so as to be kept in contact with the first cylindrical surface 32 and the respective first cam surfaces 33. When the first input shaft 20 rotates in the counterclockwise direction (in FIG. 4) relative to the rotor 6, the contact surface pressure between the first engagement elements 21 and the first cam surfaces 33 increases due to the wedge action, and thus the first engagement elements 21 are engaged with the first cylindrical surface 32 and the respective first cam surfaces 33, so that motive power is transmitted to the rotor 6 through the first engagement elements 21. On the other hand, when the first input shaft 20 rotates in the clockwise direction (in the figure) relative to the rotor 6, the contact surface pressure between the first engagement elements 21 and the first cam surfaces 33 decreases, and thus the first engagement elements 21 are disengaged from the first cylindrical surface 32 and/or the respective cam surfaces 33, so that no motive power is transmitted to the rotor 6 through the first engagement elements 21.

While the first one-way clutch 18 is a roller-type clutch in the embodiment, the first one-way clutch 18 may be a sprag-type one-way clutch as disclosed in JP 2011-106543, which uses/includes sprags as the engagement elements.

The second one-way clutch 19 (see FIGS. 1 and 3) has the same structure as the first one-way clutch 18. Namely, when the second input shaft 24 rotates in the counterclockwise direction (in FIG. 3) relative to the rotor 6, the second engagement elements 25 are engaged with a second cylindrical surface 34 provided on the second one-way clutch 19, and respective second cam surfaces 35 provided on the rotor 6, so that motive power is transmitted to the rotor 6 through the second engagement elements 25, whereas when the second input shaft 24 rotates in the clockwise direction (in FIG. 3) relative to the rotor 6, the second engagement elements 25 are disengaged, so that no motive power is transmitted to the rotor 6 through the second engagement elements 25.

The first input shaft 20 (see FIGS. 1 and 2) is configured to rotate in the counterclockwise direction (in the figure) due to the motive power output from the engine 2. Therefore, the first one-way clutch 18 transmits the motive power input from the engine 2 to the rotor 6, so that the rotor 6 rotates only in the counterclockwise direction (in FIG. 3 or 4). The second input shaft 24 (see FIGS. 1 and 2) is also configured to rotate in the counterclockwise direction (in FIG. 3 or 4) due to the motive power output from the electric motor 4. Therefore, the second one-way clutch 19 transmits the motive power input from the electric motor 4 to the rotor 6, so that the rotor 6 rotates only in the counterclockwise direction (in the figure).

Namely, since, while the engine 2 is operating, and the electric motor 4 is not operating, the first one-way clutch 18, which is a portion of the engine side transmission path 3, is engaged, the motive power output from the engine 2 is transmitted to the rotor 6 from the first one-way clutch 18. By receiving this motive power, the rotor 6 rotates in the counterclockwise direction (in 4), thereby driving the oil pump 1. The counterclockwise rotation of the rotor 6 is output to the second engagement elements 25 of the second one-way clutch 19, and since the second input shaft 24 is not rotating at this time, this means that the second input shaft 24 rotates in the clockwise direction (in FIGS. 3 and 4) relative to the rotor 6, so that the second one-way clutch 19 remains disengaged. Thus, motive power is never transmitted to the electric motor 4 through the second one-way clutch 19.

On the other hand, since, while the engine 2 is not operating, and the electric motor 4 is operating, the second one-way clutch 19, which is a portion of the motor side transmission path 5, is engaged, the motive power output from the electric motor 4 is transmitted to the rotor 6 from the second one-way clutch 19, thereby driving the oil pump 1. At this time, since the first input shaft 20 is not rotating, this means that the first input shaft 20 rotates in the clockwise direction relative to the rotor 6, so that the first one-way clutch 18 remains disengaged.

The electric motor 4 may be configured to be always operating irrespective of whether or not the engine 2 is operating. If the electric motor 4 always rotates/operates, when the engine 2 is started, the oil pump 1 is driven and controlled by one of the first and second input shafts 20 and 24 that is rotating at a higher speed than the other input shaft, because the first and second one-way clutches 18 and 19 have the same shape, and both transmit motive power only in the same one direction.

As described above, the oil pump driving device embodying the present invention is configured such that the single oil pump 1 can be driven by either of the engine 2 and the electric motor 4. Also, since, in the oil pump driving device embodying the present invention, the rotor 6 comprises a hollow rotor including an inner peripheral portion 17 defining a space, and the first and second one-way clutches 18 and 19 are arranged inside of the inner peripheral portion 17, that is, disposed within the axial width of the rotor 6, the oil pump driving device of the present invention is shorter in axial length than a conventional oil pump driving device as disclosed in JP 2011-106543 which includes one-way clutches on both sides of the oil pump.

Since, in the oil pump driving device embodying the present invention, the first one-way clutch 18 includes a first input shaft 20 inserted in the space defined inside of the inner peripheral portion 17 of the rotor 6, and first engagement elements 21 configured to transmit motive power between the first input shaft 20 and the inner peripheral portion 17 of the rotor 6, and the second one-way clutch 19 includes a second input shaft 24 inserted in the space defined inside of the inner peripheral portion 17 of the rotor 6, and second engagement elements 25 configured to transmit motive power between the second input shaft 24 and the inner peripheral portion 17 of the rotor 6, the first and second one-way clutches 18 and 19 can be received, substantially in their entireties, inside of the inner peripheral portion 17 of the rotor 6, namely, among all the components of the first and second one-way clutches 18 and 19, only the portions of the input shafts 20 and 24 that need to be connected, respectively, to the engine side transmission path 3 and the motor side transmission path 5 protrude axially beyond the rotor 6.

Since, in the oil pump driving device embodying the present invention, the first and second input shafts 20 and 24 are axially and radially opposed, through the gap 30, to each other inside of the inner peripheral portion 17 of the rotor 6, and also a bearing 31 is arranged in the gap 30, and supports the second input shaft 24 so as to be rotatable relative to the first input shaft 20, the bearing 31 prevents the run-out of the input shafts 20 and 24 in the interior space of the inner peripheral portion 17 of the rotor 6, in which the input shafts 20 and 24 cannot be supported relative to the housing 9, so that the first and second one-way clutches 18 and 19 can operate in a stable manner, and the rotor 6 can also rotate in a stable manner.

Since, in the oil pump driving device embodying the present invention, the single housing 9 retains, as a single unit, the oil pump 1, the first one-way clutch 18, the second one-way clutch 19, the first radial bearing 28, which supports the first input shaft 20, the second radial bearing 29, which supports the second input shaft 24, and the seals (oil seals S1 and S2 in the embodiment), the oil pump driving device can be easily mounted to the engine side transmission path 3 and the motor side transmission path 5.

The above embodiment is merely an example in every respect, and the present invention is not limited to the above embodiment. Therefore, the scope of the present invention is indicated not by the above description but by the claims, and should be understood to include all modifications within the scope and the meaning equivalent to the scope of the claims.

DESCRIPTION OF REFERENCE NUMERALS

1: oil pump
2: engine
4: electric motor
6: rotor
17: inner peripheral portion
18: first one-way clutch
19: second one-way clutch
20: first input shaft
21: first engagement element
24: second input shaft
25: second engagement element
30: gap
31: bearing

The invention claimed is:

1. An oil pump driving device comprising:

a single oil pump including a rotor configured to rotate by receiving motive power;

a first one-way clutch configured to transmit motive power input from an engine side, to the rotor only in one direction;

a second one-way clutch configured to transmit motive power input from an electric motor side, to the rotor only in the one direction; and a bearing, wherein:

the rotor comprises a hollow rotor including an inner peripheral portion defining a space inside of the inner peripheral portion, and the first one-way clutch and the second one-way clutch are arranged inside of the inner peripheral portion of the rotor;

the first one-way clutch comprises a first input shaft inserted in the space defined inside of the inner peripheral portion of the rotor, and first engagement elements configured to transmit motive power between the first input shaft and the inner peripheral portion of the rotor;

the second one-way clutch comprises a second input shaft inserted in the space defined inside of the inner peripheral portion of the rotor, and second engagement elements configured to transmit motive power between the second input shaft and the inner peripheral portion of the rotor;

the first input shaft and the second input shaft are axially and radially opposed, through a gap, to each other inside of the inner peripheral portion of the rotor; and the bearing is arranged in the gap, and supports the second input shaft so as to be rotatable relative to the first input shaft.

2. The oil pump driving device according to claim 1, further comprising a seal, a first radial bearing supporting the first input shaft, a second radial bearing supporting the second input shaft, and a single housing, wherein the single housing retains, as a single unit, the oil pump, the first one-way clutch, the second one-way clutch, the first radial bearing, the second radial bearing, and the seal.

3. The oil pump driving device according to claim 1, wherein one of an opposed end portion of the first input shaft and an opposed end portion of the second input shaft is a hollow end portion, and the other of the opposed end portion of the first input shaft and the opposed end portion of the second input shaft is inserted in the hollow end portion.

* * * * *